US011749186B2

(12) United States Patent
Noh et al.

(10) Patent No.: US 11,749,186 B2
(45) Date of Patent: Sep. 5, 2023

(54) DISPLAY DEVICE FOR CORRECTING AN IMAGE INCLUDING A LOGO AND DRIVING METHOD OF DISPLAY DEVICE

(71) Applicant: Samsung Display Co., Ltd., Yongin-si (KR)

(72) Inventors: DongHyun Noh, Seoul (KR); Wonwoo Jang, Seoul (KR); Kyoungho Lim, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/708,485

(22) Filed: Mar. 30, 2022

(65) Prior Publication Data

US 2022/0366843 A1 Nov. 17, 2022

(30) Foreign Application Priority Data

May 12, 2021 (KR) ..... 10-2021-0061595

(51) Int. Cl.
*G09G 3/3208* (2016.01)

(52) U.S. Cl.
CPC ... *G09G 3/3208* (2013.01); *G09G 2320/0257* (2013.01); *G09G 2320/0626* (2013.01)

(58) Field of Classification Search
None
See application file for complete search history.

(56) References Cited

U.S. PATENT DOCUMENTS 9,418,591 B2 8/2016 Kim et al.
9,666,116 B2 5/2017 Jung et al.
9,691,353 B2 6/2017 Joo et al.
10,013,920 B2 7/2018 Oh et al.
10,748,317 B2 8/2020 Park
2015/0103108 A1* 4/2015 Seong ..... G09G 3/3208 345/694
2016/0225344 A1* 8/2016 Joo ..... G06V 10/40
(Continued)

FOREIGN PATENT DOCUMENTS

KR 1020160071885 A 6/2016
KR 1020160071886 A 6/2016
KR 1020160095673 A 8/2016
(Continued)

*Primary Examiner* — Benjamin C Lee
*Assistant Examiner* — Emily J Frank
(74) *Attorney, Agent, or Firm* — CANTOR COLBURN LLP

(57) ABSTRACT

A display device includes a display panel including a correction area in which a correction image including a logo image and a logo background image is displayed, and a panel driving block. The panel driving block includes a luminance correction block which corrects a luminance of the correction image, and the luminance correction block includes a first correction block which divides the correction area into a plurality of sub-areas, based on a distance from the logo image and generates an area correction signal for correcting the luminance of the correction image, a second correction block which generates a luminance correction signal for correcting the luminance of the correction image displayed in each of the sub-areas, based on a grayscale of the image signal and the area correction signal, and a third correction block which corrects the luminance of the correction image.

20 Claims, 8 Drawing Sheets

(56) References Cited

U.S. PATENT DOCUMENTS

| | | | | |
|---|---|---|---|---|
| 2019/0035339 | A1* | 1/2019 | Sako | G09G 3/3648 |
| 2020/0074708 | A1* | 3/2020 | Park | G06T 7/90 |

FOREIGN PATENT DOCUMENTS

| | | | |
|---|---|---|---|
| KR | 1020170136086 | A | 12/2017 |
| KR | 101947125 | B1 | 2/2019 |
| KR | 1020200027617 | A | 3/2020 |
| KR | 102111777 | B1 | 5/2020 |

* cited by examiner

DISPLAY DEVICE FOR CORRECTING AN IMAGE INCLUDING A LOGO AND DRIVING METHOD OF DISPLAY DEVICE

This application claims priority to Korean Patent Application No. 10-2021-0061595, filed on May 12, 2021, and all the benefits accruing therefrom under 35 U.S.C. § 119, the content of which in its entirety is herein incorporated by reference.

BACKGROUND

1. Fields

Embodiments of the disclosure described herein relate to a display device and a driving method of the display device, and more particularly, relate to a display device for displaying an image including a logo, and a driving method of the display device.

2. Description of the Related Art

Various types of display device are widely used in various fields to provide image information. In particular, such various types of display device may include an organic light emitting display ("OLED") device, a quantum dot display device, a liquid crystal display ("LCD") device and a plasma display device, for example.

The display device typically includes a display panel for displaying an image and a driving circuit coupled to the display panel to provide a driving signal to the display panel. The display panel may include pixels that generate light. The organic light emitting display device includes an organic light emitting diode that emits light.

SUMMARY

Embodiments of the disclosure provide a display device capable of preventing image quality degradation from being recognized by a user due to a lowered grayscale of a logo background image around a logo image.

According to an embodiment of the disclosure, a display device includes a display panel including a correction area in which a correction image including a logo image and a logo background image around the logo image is displayed, and a panel driving block which receives an image signal and transmitting a data signal to the display panel. In such an embodiment, the panel driving block includes a luminance correction block which corrects a luminance of the correction image. In such an embodiment, the luminance correction block includes a first correction block which divides the correction area into a plurality of sub-areas, based on a distance from the logo image and generates an area correction signal for correcting the luminance of the correction image displayed in each of the sub-areas. In such an embodiment, the luminance correction block further includes a second correction block which receives the image signal and the area correction signal, and generates a luminance correction signal for correcting the luminance of the correction image displayed in each of the sub-areas, based on a grayscale of the image signal and the area correction signal. In such an embodiment, the luminance correction block further includes a third correction block which corrects the luminance of the correction image, based on the image signal and the luminance correction signal.

According to an embodiment, the luminance correction block may further include a correction grayscale generation block which receives the image signal and generates a correction grayscale signal obtained by correcting the grayscale of the image signal.

According to an embodiment, the second correction block may receive the area correction signal from the first correction block and may receive the correction grayscale signal from the correction grayscale generation block. The second correction block may generate the luminance correction signal based on the area correction signal and the correction grayscale signal.

According to an embodiment, the correction grayscale generation block may generate the correction grayscale signal, based on a correction grayscale obtained by multiplying the grayscale of the image signal by a correction constant.

According to an embodiment, the correction constant may have a value of n, where n may be a real number equal to or greater than 1.

According to an embodiment, the image signal having a greater grayscale than a preset reference grayscale among image signals may have a same grayscale as a grayscale in the correction grayscale signal.

According to an embodiment, as the preset reference grayscale decreases, the correction constant may increase.

According to an embodiment, the correction grayscale generation block may normalize the correction grayscale to generate the correction grayscale signal.

According to an embodiment, the luminance correction block may further include an extraction block which extracts an area calculation signal for the correction area from the image signal. In such an embodiment, the first correction block may receive the area calculation signal from the extraction block and may generate the area correction signal based on the area calculation signal.

According to an embodiment, the sub-areas may include a first sub-area in which the logo image is displayed, a third sub-area in which the logo background image is displayed, and a second sub-area disposed between the first sub-area and the third sub-area. In such an embodiment, the area correction signal may include a first area correction value for correcting a luminance of an image displayed on the first sub-area, and a second area correction value for correcting a luminance of an image displayed on the second sub-area. In such an embodiment, the area correction signal may further include a third area correction value for correcting a luminance of an image displayed on the third sub-area.

According to an embodiment, the first area correction value may be greater than the second area correction value and the third area correction value. In such an embodiment, the second area correction value may be greater than the third area correction value.

According to an embodiment, as the grayscale of the image signal is lower, a luminance correction amount of the correction area corrected through the luminance correction block may become smaller.

According to an embodiment, the panel driving block may include a controller which receives the image signal from an outside and generates image data based on the image signal. In such an embodiment, the panel driving block may include a source driver which receives the image data from the controller and transmits the data signal to the display panel. In such an embodiment, the luminance correction block may be included in the controller.

According to an embodiment of the disclosure, a display device includes a display panel including a correction area in which a correction image including a logo image and a logo background image around the logo image is displayed, and a panel driving block which receives an image signal and transmits a data signal to the display panel. In such an embodiment, a method of driving the display device includes correcting a luminance of the correction image when the data signal is generated based on the image signal. In such an embodiment, the correcting the luminance of the correction image includes dividing the correction area into a plurality of sub-areas based on a distance from the logo image, and generating an area correction signal for correcting the luminance of the correction image displayed in each of the sub-areas. In such an embodiment, the correcting the luminance of the correction image further includes receiving the image signal and the area correction signal, and generating a luminance correction signal for correcting the luminance of the correction image displayed in each of the sub-areas, based on a grayscale of the image signal and the area correction signal. In such an embodiment, the correcting the luminance of the correction image further includes correcting the luminance of the correction image, based on the image signal and the luminance correction signal.

According to an embodiment, the correcting of the luminance of the correction image may further include receiving the image signal, and generating a correction grayscale signal based on a correction grayscale obtained by multiplying the grayscale of the image signal by a correction constant.

According to an embodiment, the generating of the luminance correction signal may include receiving the area correction signal from a first correction block, and receiving the correction grayscale signal from a correction grayscale generation block. In such an embodiment, the generating the luminance correction signal may include generating the luminance correction signal based on the area correction signal and the correction grayscale signal.

According to an embodiment, the image signal having a greater grayscale than a preset reference grayscale among image signals may have a same grayscale as a grayscale in the correction grayscale signal.

According to an embodiment, the correction grayscale signal may be generated by normalizing the correction grayscale.

According to an embodiment, the correcting the luminance of the correction image may further include extracting an area calculation signal for the correction image from the image signal. In such an embodiment, the area correction signal may be generated based on the area calculation signal when the area correction signal is generated.

According to an embodiment, the sub-areas may include a first sub-area in which the logo image is displayed, a third sub-area in which the logo background image is displayed, and a second sub-area disposed between the first sub-area and the third sub-area. In such an embodiment, the area correction signal may include a first area correction value for correcting a luminance of an image displayed on the first sub-area, and a second area correction value for correcting a luminance of an image displayed on the second sub-area. In such an embodiment, The area correction signal may further include a third area correction value for correcting a luminance of an image displayed on the third sub-area. In such an embodiment, the first area correction value may be greater than the second area correction value and the third area correction value. In such an embodiment, the second area correction value may be greater than the third area correction value.

BRIEF DESCRIPTION OF THE FIGURES

The above and other features of the disclosure will become apparent by describing in detail embodiments thereof with reference to the accompanying drawings.

DETAILED DESCRIPTION

Figure 1:
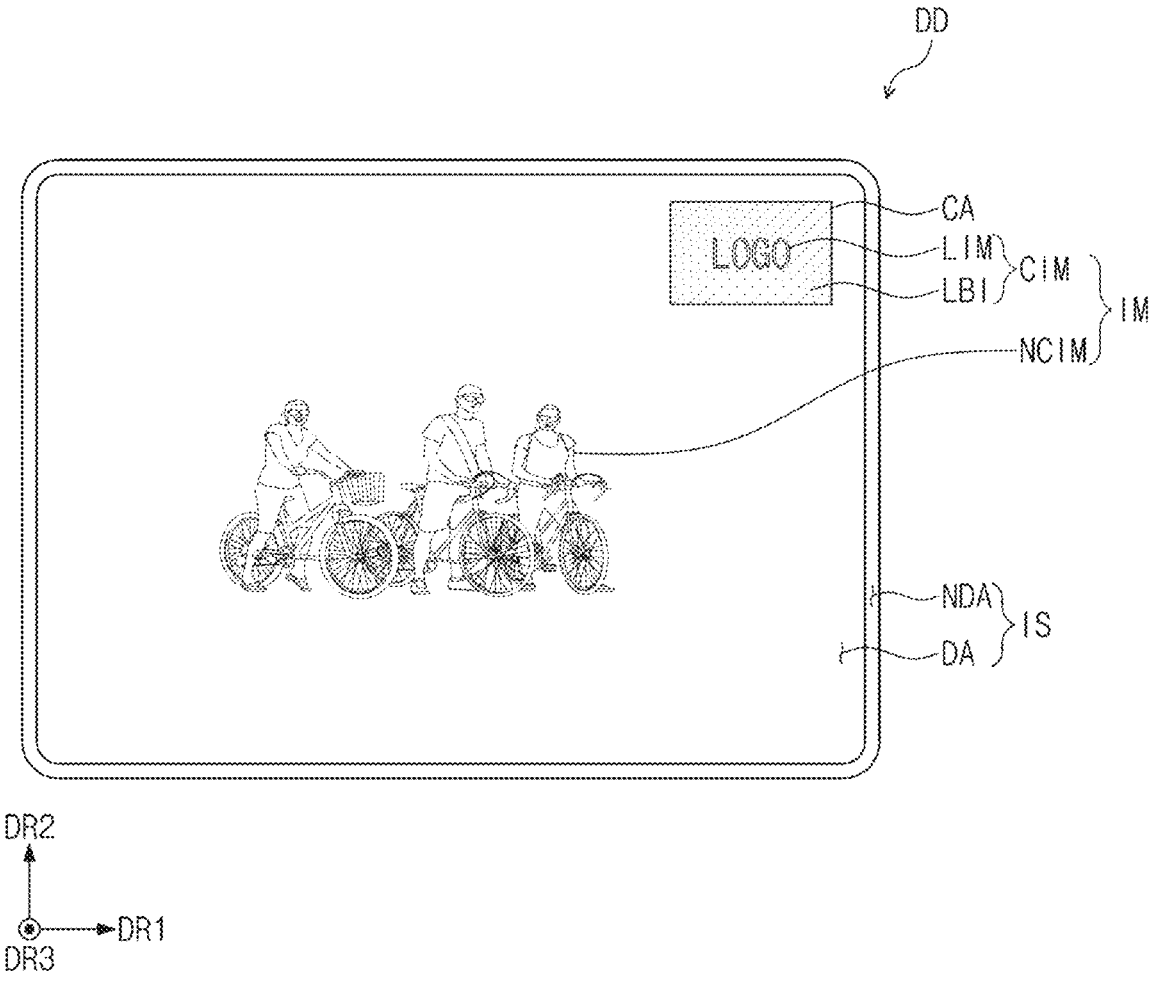
FIG. 1 is a plan view of a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

In the specification, when one component (or area, layer, part, or the like) is referred to as being "on", "connected to", or "coupled to" another component, it should be understood that the former may be directly on, connected to, or coupled to the latter, and also may be on, connected to, or coupled to the latter via a third intervening component. In contrast, when an element is referred to as being "directly on" another element, there are no intervening elements present.

Like reference numerals refer to like components. Also, in drawings, the thickness, ratio, and dimension of components are exaggerated for effectiveness of description of technical contents.

The terms" "first", "second", etc. are used to describe various components, but the components are not limited by the terms. The terms are used only to differentiate one component from another component. For example, a first component may be named as a second component, and vice versa, without departing from the spirit or scope of the disclosure. A singular form, unless otherwise stated, includes a plural form.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Also, the terms "under", "beneath", "on", "above" are used to describe a relationship between components illustrated in a drawing. The terms are relative and are described with reference to a direction indicated in the drawing. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

Unless defined otherwise, all terms (including technical and scientific terms) used herein have the same meaning as commonly understood by one of ordinary skill in the art to which this disclosure belongs. In addition, terms such as terms defined in commonly used dictionaries should be interpreted as having a meaning consistent with the meaning in the context of the related technology, and should not be interpreted as an ideal or excessively formal meaning unless explicitly defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to accompanying drawings.

Figure 2:
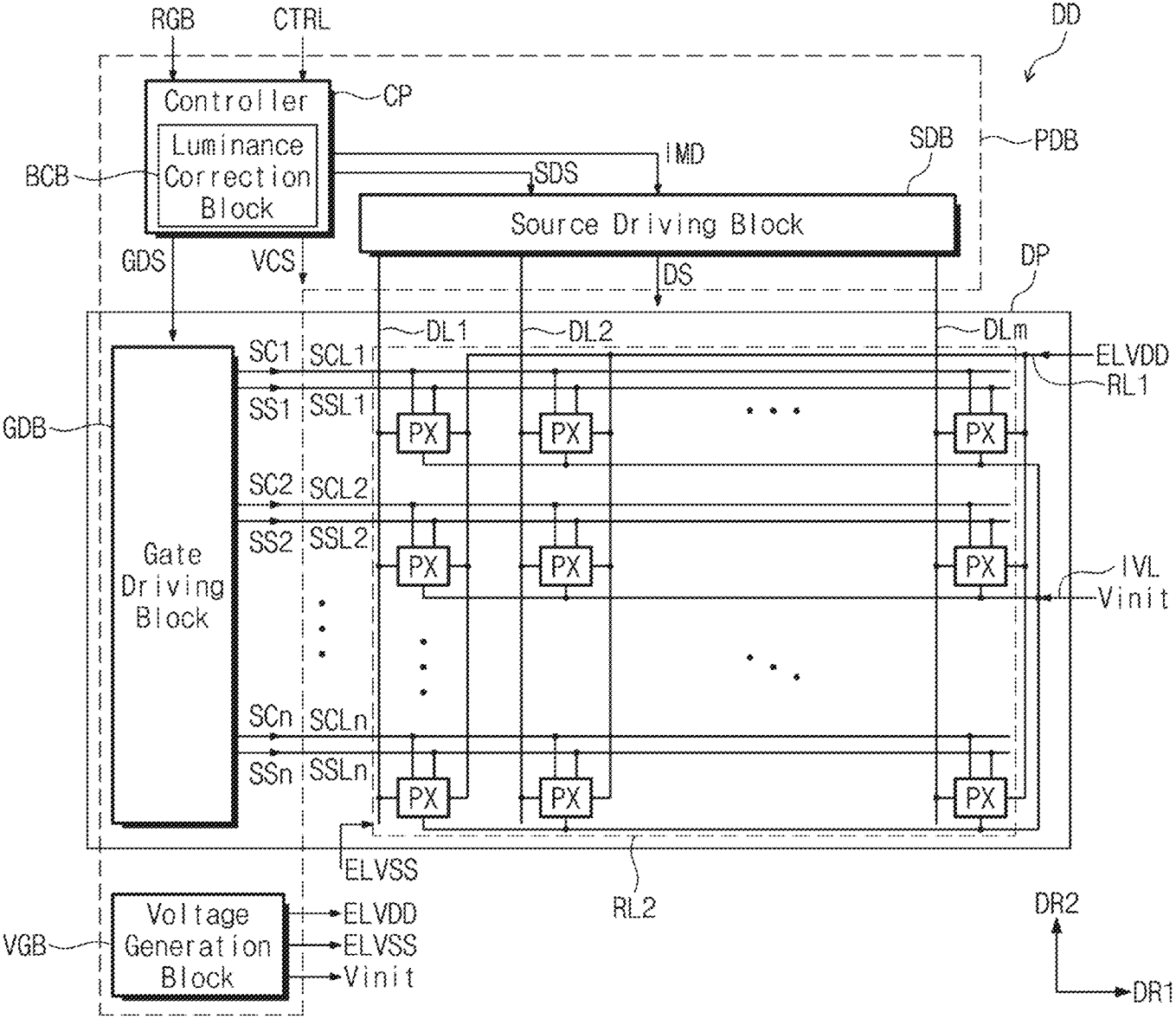
FIG. 2 is a block diagram of a display device illustrated in FIG. 1.

FIG. 1 is a plan view of a display device according to an embodiment of the disclosure, and FIG. 2 is a block diagram of a display device illustrated in FIG. 1.

Referring to FIG. 1, an embodiment of a display device DD may be a device that is activated depending on an electrical signal. In an embodiment, the display device DD may be a large display device such as a television, a monitor, etc., as well as a small and medium-sized device such as a mobile phone, a tablet, a car navigation device, a game console, etc., for example, but not being limited thereto. Alternatively, the display device DD may be applied to other electronic devices without departing from the concept of the disclosure.

The display device DD has a rectangular shape having a long side extending in a first direction DR1 and a short side extending in a second direction DR2 crossing the first direction DR1. In one embodiment, for example, the second direction DR2 may be perpendicular to the first direction DR1. However, the shape of the display device DD is not limited thereto, and various shapes of the display device DD may be provided.

The display device DD may display an image IM in a third direction DR3 on a display surface IS parallel to each of the first direction DR1 and the second direction DR2. The display surface IS on which the image IM is displayed may correspond to the front surface of the display device DD.

In an embodiment, a front surface (or upper surface) and a rear surface (or lower surface) of each member are defined based on a direction in which the image IM is displayed. The front surface and the rear surface may be opposed to each other in the third direction DR3, and a normal direction of each of the front surface and the rear surface may be parallel to the third direction DR3.

A distance between the front surface and the rear surface in the third direction DR3 may correspond to a thickness of the display device DD in the third direction DR3. Herein, the directions indicated by the first to third directions DR1, DR2, and DR3 are relative concepts and may be converted into other directions.

Referring to FIGS. 1 and 2, an embodiment of the display device DD includes a display panel DP that displays the image IM and a panel driving block PDB that drives the display panel DP. In an embodiment of the disclosure, the panel driving block PDB may include a controller CP, a source driving block SDB, a gate driving block GDB, and a voltage generating block VGB.

An embodiment of the display panel DP may be a light emitting display panel. In one embodiment, for example, the display panel DP may be an organic light emitting display panel, an inorganic light emitting display panel, or a quantum dot light emitting display panel. An emission layer of the organic light emitting display panel may include an organic light emitting material. An emission layer of the inorganic light emitting display panel may include an inorganic light emitting material. An emission layer of the quantum dot light emitting display panel may include quantum dots, quantum rods, etc.

The display panel DP includes a display area DA that displays the image IM and a non-display area NDA adjacent to the periphery of the display area DA. The display area DA is an area in which an image is actually displayed, and the non-display area NDA is a bezel area in which an image is not displayed. In an embodiment, as shown in FIG. 1, the display area DA may have a rectangular shape with rounded vertices, but not being limited thereto. Alternatively, the display area DA may have one of other various shapes, for example.

The non-display area NDA may have a predetermined color. In one embodiment, for example, the non-display area NDA may surround the display area DA, such that the shape of the display area DA may be defined by the non-display area NDA. Alternatively, the non-display area NDA may be disposed adjacent to only one side of the display area DA, or may be omitted.

The image IM displayed on the display panel DP may include a correction image CIM and a non-correction image NCIM. The correction image CIM may include a logo image LIM and a logo background image LBI. In an embodiment of the disclosure, the display area DA may include a correction area CA in which the correction image CIM is displayed.

The logo image LIM may be an image displayed at a fixed position for a preset time or longer with a specific grayscale. In one embodiment, for example, the logo image LIM may include a broadcaster logo, subtitles, date, time, etc. The logo image LIM may include a title of a program, etc. Hereinafter, for convenience of description, various types of images displayed at a fixed position with a specific grayscale for a preset time or longer will be referred to as the logo image LIM. The logo background image LBI may be an image displayed around the logo image LIM. The correction image CIM may be an image of which luminance is corrected by a luminance correction block BCB shown in FIG. 2, which will be described later.

The non-correction image NCIM may be an image displayed in the display area DA except for the correction image CIM. The non-correction image NCIM may be an image of which luminance is not corrected by the luminance correction block BCB.

In an embodiment of the disclosure, the logo image LIM may have a relatively high grayscale compared to the logo background image LBI and the non-correction image NCIM. However, the disclosure is not limited thereto, and the logo image LIM may have a same grayscale as the logo background image LBI.

The controller CP receives an image signal RGB and a control signal CTRL from the outside. The control signal CTRL may include a vertical synchronization signal, a horizontal synchronization signal, and a main clock.

The controller CP converts a data format of the image signal RGB to match an interface specification of the source driving block SDB to generate image data IMD. The controller CP generates a gate control signal GDS, a source control signal SDS, and a voltage control signal VCS, based on the control signal CTRL. The controller CP transmits the image data IMD and the source control signal SDS to the source driving block SDB. The controller CP transmits the gate control signal GDS to the gate driving block GDB. The controller CP transmits the voltage control signal VCS to the voltage generating block VGB.

The source driving block SDB receives the source control signal SDS and the image data IMD from the controller CP. The source control signal SDS may include a horizontal initiate signal that initiates an operation of the source driving block SDB. The source driving block SDB generates a data signal DS based on the image data IMD in response to the source control signal SDS. The source driving block SDB outputs the data signal DS to a plurality of data lines DL1 to DLm to be described later. The data signal DS is an analog voltage corresponding to a grayscale value of the image data IMD.

The gate driving block GDB receives the gate control signal GDS from the controller CP. The gate control signal GDS may include a vertical initiate signal that initiates an operation of the gate driving block GDB, and a scan clock signal that determines output timing of first scan signals SC1 to SCn and second scan signals SS1 to SSn. The gate driving block GDB generates the first scan signals SC1 to SCn and the second scan signals SS1 to SSn, based on the gate control signal GDS. The gate driving block GDB sequentially outputs the first scan signals SC1 to SCn to a plurality of first scan lines SCL1 to SCLn to be described later, and sequentially outputs the second scan signals SS1 to SSn to a plurality of second scan lines SSL1 to SSLn to be described later.

The voltage generating block VGB receives the voltage control signal VCS from the controller CP. The voltage generating block VGB generates voltages used for an operation of the display panel DP. In an embodiment of the disclosure, the voltage generating block VGB generates a first driving voltage ELVDD, a second driving voltage ELVSS, and an initialization voltage Vinit.

In an embodiment of the disclosure, the display panel DP includes the plurality of first scan lines SCL1 to SCLn, the plurality of second scan lines SSL1 to SSLn, the plurality of data lines DL1 to DLm, and a plurality of pixels PX. The first scan lines SCL1 to SCLn and the second scan lines SSL1 to SSLn extend from the gate driving block GDB in the first direction DR1 and are arranged to be spaced apart from each other in the second direction DR2. The data lines DL1 to DLm extend in a direction opposite to the second direction DR2 from the source driving block SDB and are arranged to be spaced apart from each other in the first direction DR1.

Each of the plurality of pixels PX is electrically connected to a corresponding one of the first scan lines SCL1 to SCLn and a corresponding one of the second scan lines SSL1 to SSLn. In addition, each of the plurality of pixels PX is electrically connected to a corresponding one of the data lines DL1 to DLm.

Each of the plurality of pixels PX is electrically connected to a first power line RL1, a second power line RL2, and an initialization power line IVL. The first power line RL1 receives the first driving voltage ELVDD. The second power line RL2 receives the second driving voltage ELVSS. The initialization power line IVL receives the initialization voltage Vinit. In an embodiment of the disclosure, the second power line RL2 may be disposed or formed to overlap two or more pixels.

The pixels PX may include a plurality of groups including organic light emitting diodes that generate light of different colors from one another. In one embodiment, for example, the pixels PX may include red pixels that generates red color light, green pixels that generates green color light, and blue pixels that generates blue color light. The organic light emitting diode of the red pixel, the organic light emitting diode of the green pixel, and the organic light emitting diode of the blue pixel may include emission layers of different materials from each other.

The panel driving block PDB may further include the luminance correction block BCB. In an embodiment of the disclosure, the luminance correction block BCB may be included in the controller CP. In an embodiment, the luminance correction block BCB may correct a luminance of the correction image CIM to prevent deterioration of the pixel PX and generation of an afterimage due to the logo image LIM displayed through the same pixel PX for a long time. In an embodiment of the disclosure, the luminance correction block BCB may decrease the luminance of the correction image CIM.

In an embodiment of the disclosure, the luminance correction block BCB may correct only the luminance of the logo image LIM among the correction image CIM. The luminance correction block BCB may lower the luminance of the logo image LIM.

A configuration and an operation of the luminance correction block BCB will be described later in greater detail with reference to FIGS. 4 to 10.

Figure 3:
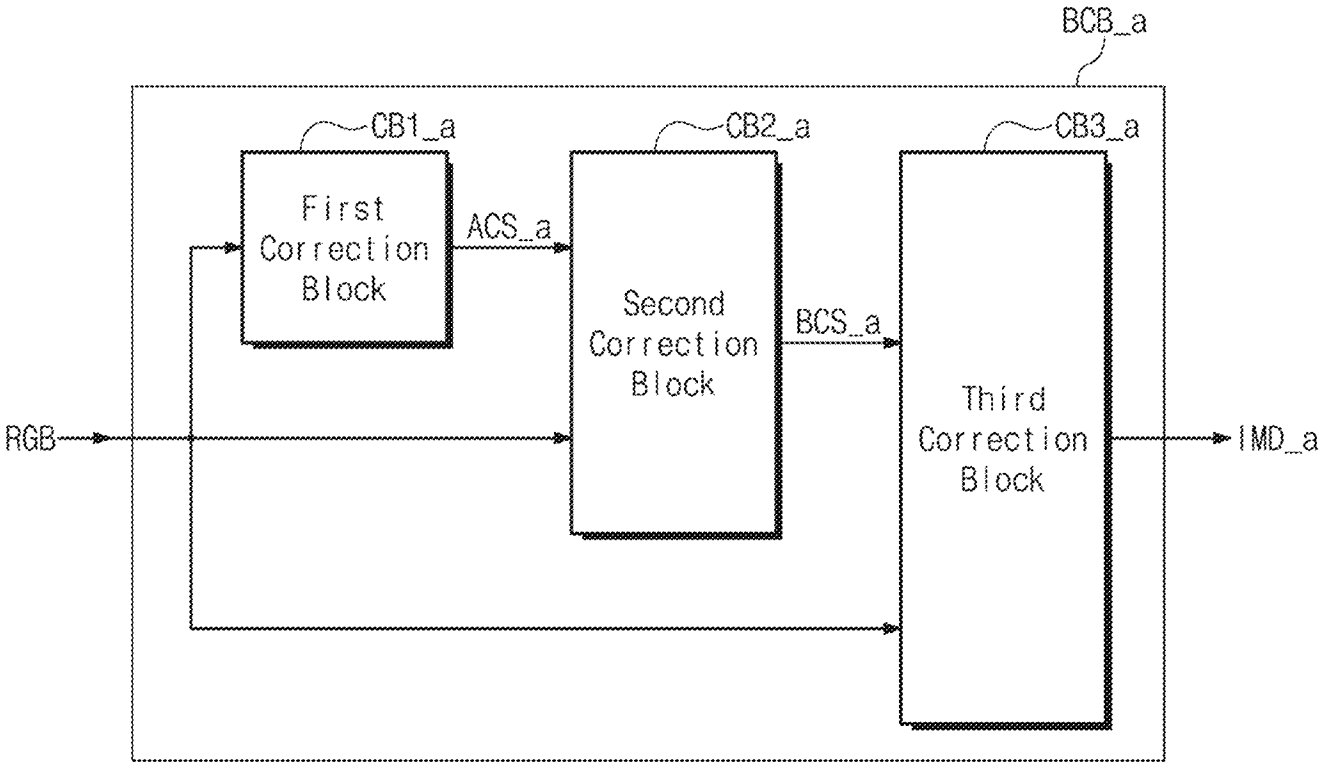
FIG. 3 is a block diagram illustrating a luminance correction block according to an embodiment of the disclosure.
Figure 4:
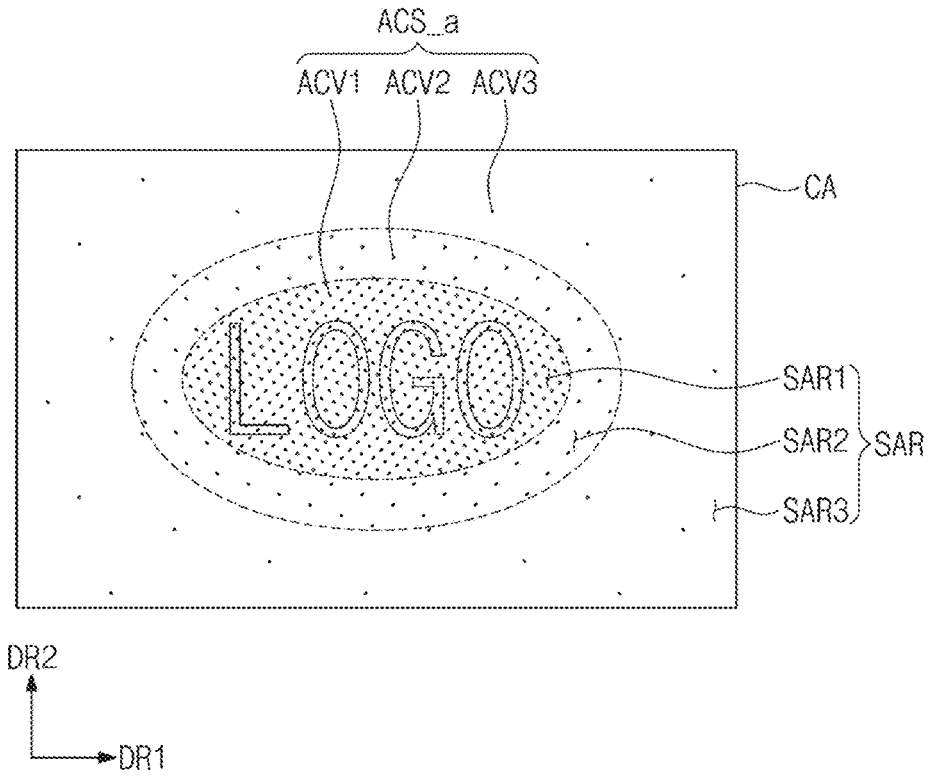
FIG. 4 is a conceptual diagram for describing an area correction signal according to an embodiment of the disclosure.
Figure 5:
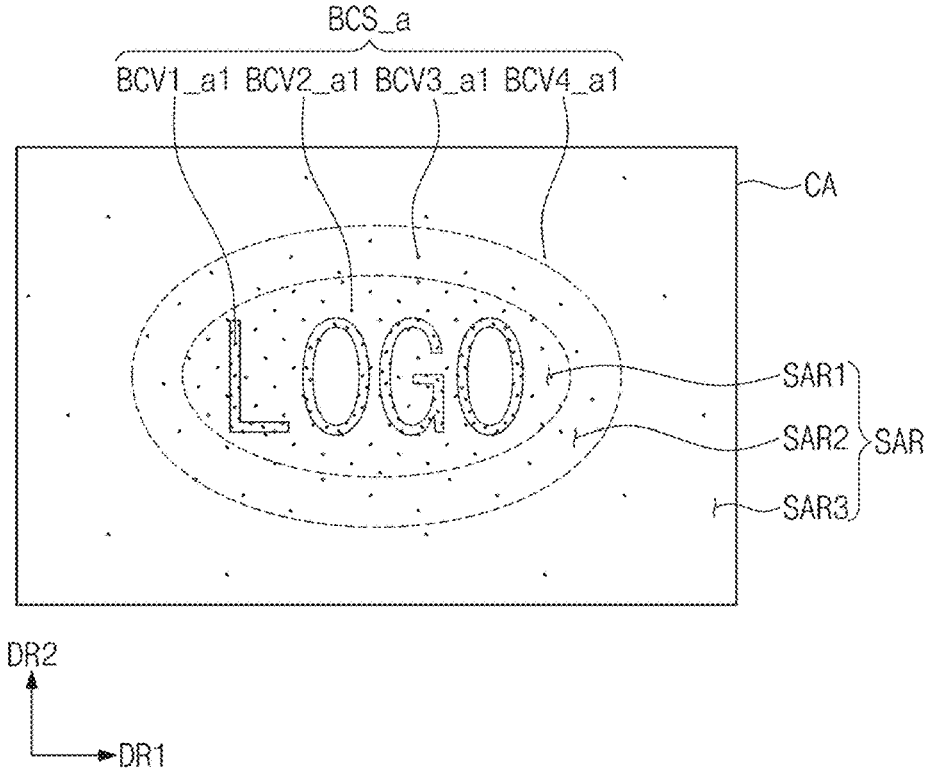
FIG. 5 is a conceptual diagram for describing a luminance correction signal according to an embodiment of the disclosure.

FIG. 3 is a block diagram illustrating a luminance correction block according to an embodiment of the disclosure. FIG. 4 is a conceptual diagram for describing an area correction signal according to an embodiment of the disclosure. FIG. 5 is a conceptual diagram for describing a luminance correction signal according to an embodiment of the disclosure.

Referring to FIGS. 3 to 5, an embodiment of a luminance correction block BCB_a may include a first correction block CB1_*a*, a second correction block CB2_*a*, and a third correction block CB3_*a*.

The first correction block CB1_*a* receives the image signal RGB from the outside. The first correction block CB1_*a* divides the correction area CA into a plurality of sub-areas SAR based on a distance from the logo image LIM and generates an area correction signal ACS_a for correcting the luminance of the correction image CIM displayed in each sub-area.

The first correction block CB1_*a* may divide the correction area CA into a first sub-area SAR1, a second sub-area SAR2, and a third sub-area SAR3. The first sub-area SAR1 may be an area in which the logo image LIM is displayed. In an embodiment of the disclosure, a part of the logo image LIM and the logo background image LBI may be displayed in the first sub-area SAR1.

The second and third sub-areas SAR2 and SAR3 may be areas in which the logo background image LBI (refer to FIG. 1) is displayed. The second sub-area SAR2 may be disposed between the first sub-area SAR1 and the third sub-area SAR3.

However, the number of sub-areas is not limited thereto, and alternatively, the first correction block CB1_a may divide the correction area CA into two sub-areas or four or more sub-areas.

The first sub-area SAR1 includes a logo area in which the logo image LIM is displayed. A distance between the second sub-area SAR2 and the logo area is closer than a distance between the third sub-area SAR3 and the logo area.

The area correction signal ACS_a includes a plurality of area correction values. In an embodiment of the disclosure, the area correction values includes a first area correction value ACV1 for correcting the luminance of the image signal RGB corresponding to the image displayed in the first sub-area SAR1, a second area correction value ACV2 for correcting the luminance of the image signal RGB corresponding to the image displayed in the second sub-area SAR2, and a third area correction value ACV3 for correcting the luminance of the image signal RGB corresponding to the image displayed in the third sub-area SAR3.

In an embodiment of the disclosure, the first to third area correction values ACV1, ACV2, and ACV3 may be weights that determine a degree to which the third correction block CB3_a, which will be described later, corrects the luminance of the correction image CIM. As the first to third area correction values ACV1, ACV2, and ACV3 increase, the degree to which the third correction block CB3_a corrects the luminance of the correction image CIM (refer to FIG. 1) may increase.

In an embodiment of the disclosure, in FIG. 4, the first area correction value ACV1 is corresponded to a density of black dots disposed in the first sub-area SAR1. The second area correction value ACV2 is corresponded to a density of black dots disposed in the second sub-area SAR2, and the third area correction value ACV3 is corresponded to a density of black dots disposed in the third sub-area SAR3.

The area correction values varies based on the distance from the logo image LIM. In an embodiment of the disclosure, the first area correction value ACV1 is greater than the second area correction value ACV2 and the third area correction value ACV3. The second area correction value ACV2 is greater than the third area correction value ACV3.

The second correction block CB2_a receives the image signal RGB from the outside, and receives the area correction signal ACS_a from the first correction block CB1_a. The second correction block CB2_a generates a luminance correction signal BCS_a for correcting the luminance of the image signal RGB corresponding to the image displayed in each of the sub-areas SAR1, SAR2, and SAR3, based on the grayscale of the image signal RGB and the area correction signal ACS_a.

In an embodiment of the disclosure, the second correction block CB2_a may correct the area correction values included in the area correction signal ACS_a, based on the grayscale of the image signal RGB corresponding to the image displayed in each of the sub-areas SAR1, SAR2, and SAR3 to generate the luminance correction signal BCS_a. In an embodiment of the disclosure, referring to FIGS. 1 and 4, an image signal corresponding to "LOGO" which is the logo image LIM among images displayed on the first sub-area SAR1 may have a relatively high grayscale. In an embodiment, the logo background image LBI displayed on the first sub-area SAR1 and the logo background image LBI displayed on the second and third sub-areas SAR2 and SAR3 may have a lower grayscale than the logo image LIM. The second correction block CB2_a determines grayscales of the logo image LIM and the logo background image LBI, based on the grayscale of the image signal RGB. The second correction block CB2_a generates the luminance correction signal BCS_a by correcting the first to third area correction values ACV1, ACV2, and AVC3 in response to the determining results.

The luminance correction signal BCS_a includes a first luminance correction value BCV1_a1, a second luminance correction value BCV2_a1, a third luminance correction value BCV3_a1, and a fourth luminance correction value BCV4_a1.

The first luminance correction value BCV1_a1 is a value obtained by correcting a first area correction value AVC1, based on the grayscale of the image signal corresponding to "LOGO", which is the logo image LIM displayed in the first sub-area SAR1. The second luminance correction value BCV2_a1 is a value obtained by correcting the first area correction value AVC1, based on the grayscale of the image signal corresponding to the logo background image LBI displayed in the first sub-area SAR1. The third luminance correction value BCV3_a1 is a value obtained by correcting a second area correction value AVC2, based on the grayscale of the image signal corresponding to the logo background image LBI displayed in the second sub-area SAR2. The fourth luminance correction value BCV4_a1 is a value obtained by correcting a third area correction value AVC3, based on the grayscale of the image signal corresponding to the logo background image LBI displayed in the third sub-area SAR3.

However, the disclosure is not limited thereto, and alternatively, the luminance correction values included in the luminance correction signal BCS_a may vary based on the grayscale of the image signal RGB corresponding to the logo image LIM.

Since the logo image LIM and the logo background image LBI displayed on the first sub-area SAR1 have different grayscales from each other, the second correction block CB2_a may generate the first luminance correction value BCV1_a1 and the second luminance correction value BCV2_a1 different from each other based on the first area correction value AVC1. In an embodiment of the disclosure, the first luminance correction value BCV1_a1 may be greater than the second luminance correction value BCV2_a1.

The second correction block CB2_a may normalize the grayscale of the image signal RGB, based on the preset highest grayscale. In this case, the first to fourth luminance correction values BCV1_a1, BCV2_a1, BCV3_a1, and BCV4_a1 of the luminance correction signal BCS_a may be the same as or less than the first to third area correction values AVC1, AVC2, and AVC3 of the area correction signal ACS_a. In an embodiment of the disclosure, the highest grayscale may be preset to 255. However, the disclosure is not limited thereto, and the highest grayscale may be preset as the highest grayscale among grayscales included in the image signal RGB. Hereinafter, for convenience of description of the disclosure, an embodiment where the preset highest grayscale is set to 255 will be described.

In an embodiment, when the grayscale of the image signal corresponding to the logo image LIM is 255, the first luminance correction value BCV1_a1 may be the same value as the first area correction value AVC1. In an embodiment, when the grayscale of the image signal corresponding to the logo background image LBI is less than 255, the second luminance correction value BCV2_a1 may be smaller than the first area correction value AVC1. In such an embodiment, the third luminance correction value BCV3_a1 may be less than the second area correction value AVC2, and the fourth luminance correction value BCV4_a1 may be less than the third area correction value ACV3.

The third correction block CB3_a receives the image signal RGB from the outside, and receives the luminance correction signal BCS_a from the second correction block CB2_a. The third correction block CB3_a corrects the luminance of the image signal RGB corresponding to the image displayed in the correction area CA, based on the image signal RGB and the luminance correction signal BCS_a. The third correction block CB3_a corrects the luminance of the correction image CIM, based on the image signal RGB and the luminance correction signal BCS_a. The third correction block CB3_a may correct the luminance of the correction image CIM based on the image signal RGB and the luminance correction signal BCS_a and may generate image data IMD_a.

The third correction block CB3_a may vary the degree of correcting the luminance of the image signal RGB corresponding to the image displayed in the correction area CA based on the first to fourth luminance correction values BCV1_a1, BCV2_a1, BCV3_a1, and BCV4_a1 of the luminance correction signal BCS_a. In an embodiment of the disclosure, the third correction block CB3_a may correct greatly the luminance of the logo image LIM corresponding to the luminance correction signal BCS_a having the first luminance correction value BCV1_a1 among the correction image CIM. The third correction block CB3_a may correct the luminance of the logo background image LBI displayed in the first sub-area SAR1 corresponding to the luminance correction signal BCS_a having the second luminance correction value BCV2_a1 among the correction image CIM to be less than the luminance of the logo image LIM.

The third correction block CB3_a may correct the luminance of the logo background image LBI displayed in the second sub-area SAR2 corresponding to the luminance correction signal BCS_a having the third luminance correction value BCV3_a1 among the correction image CIM to be less than the luminance of the logo background image LBI displayed in the first sub-area SAR1. The third correction block CB3_a may correct the luminance of the logo background image LBI displayed in the third sub-area SAR3 corresponding to the luminance correction signal BCS_a having the fourth luminance correction value BCV4_a1 among the correction image CIM to the smallest level.

According to embodiments of the disclosure, as the grayscale of the image signal corresponding to the logo background image LBI decreases, the third correction block CB3_a may decrease the degree of correcting the luminance of the logo background image LBI. Accordingly, it is possible to prevent the user from unrecognizing the logo background image LBI due to excessively low luminance of the logo background image LBI, and to prevent the user from recognizing a boundary between the logo background image LBI and the non-correction image NCIM.

Figure 6:
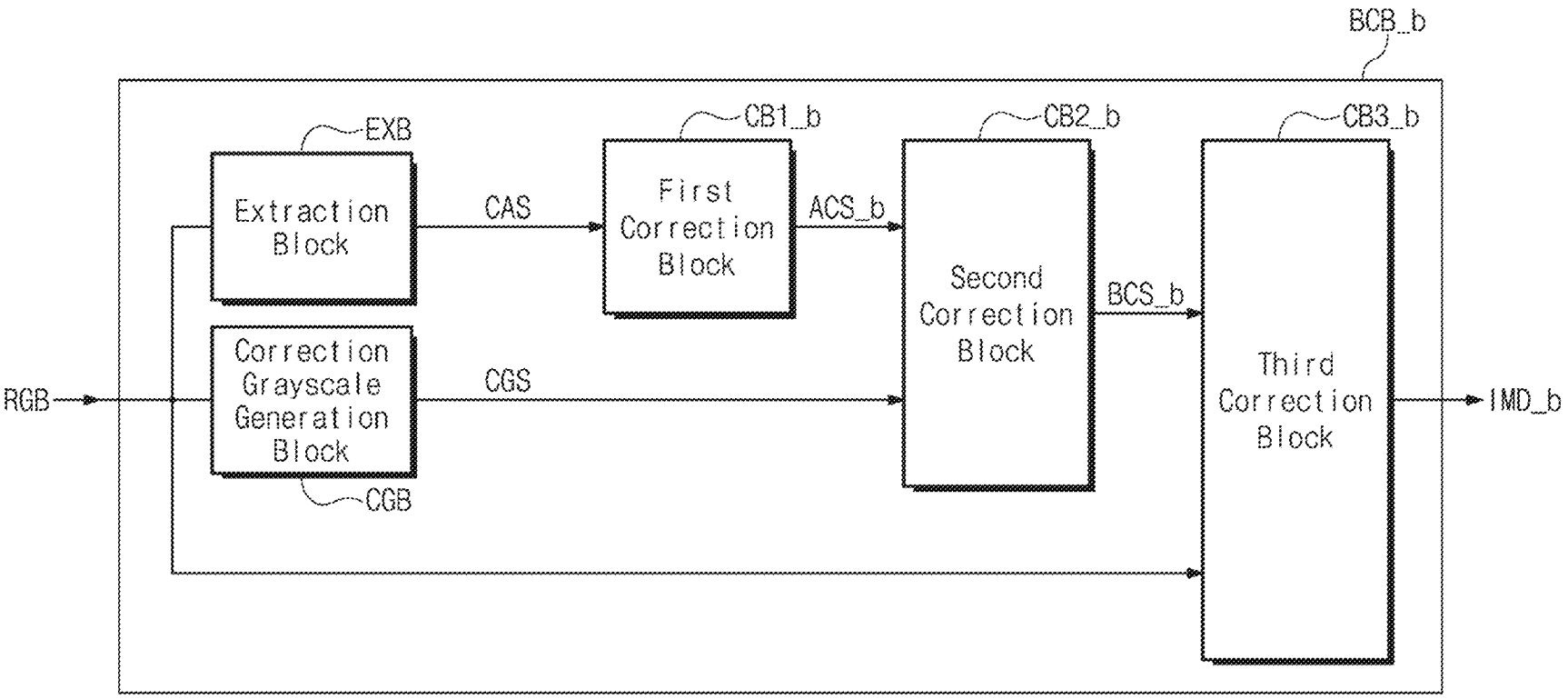
FIG. 6 is a block diagram illustrating a luminance correction block according to an embodiment of the disclosure.
Figure 7A:
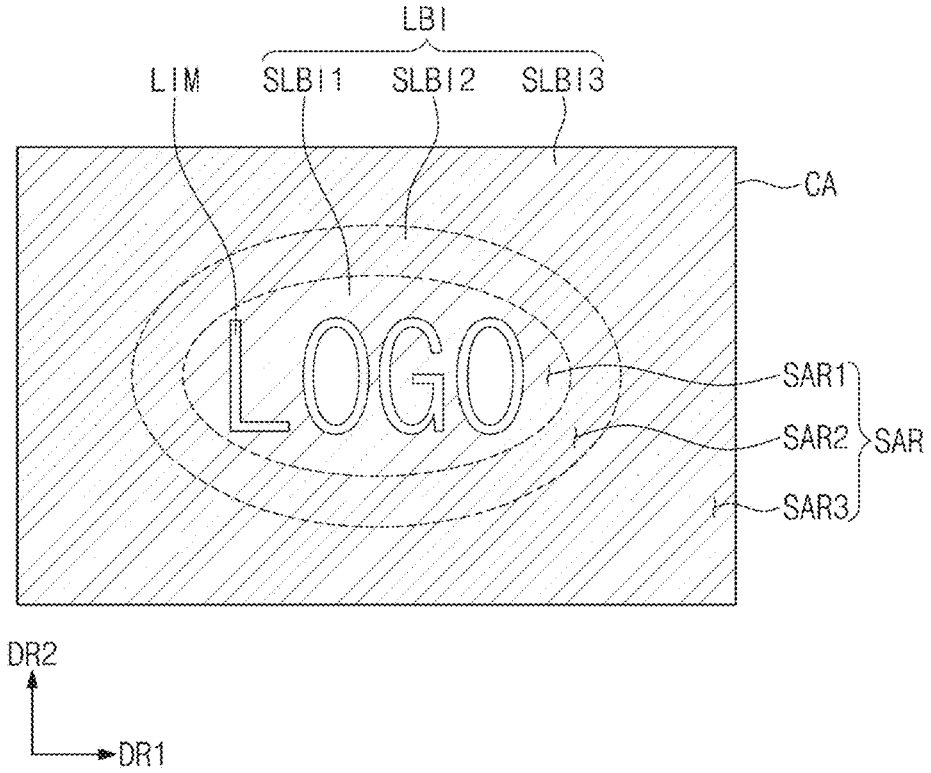
FIGS. 7A and 7B are conceptual diagrams for describing an operation of a correction grayscale generation block according to an embodiment of the disclosure.
Figure 7B:
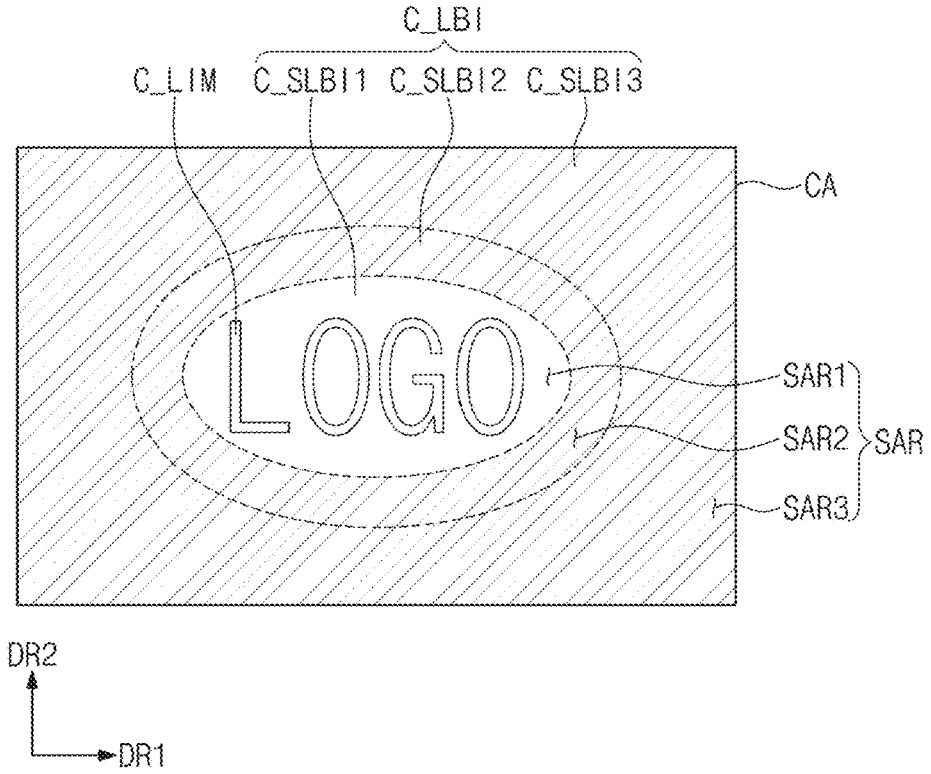
Figure 8A:
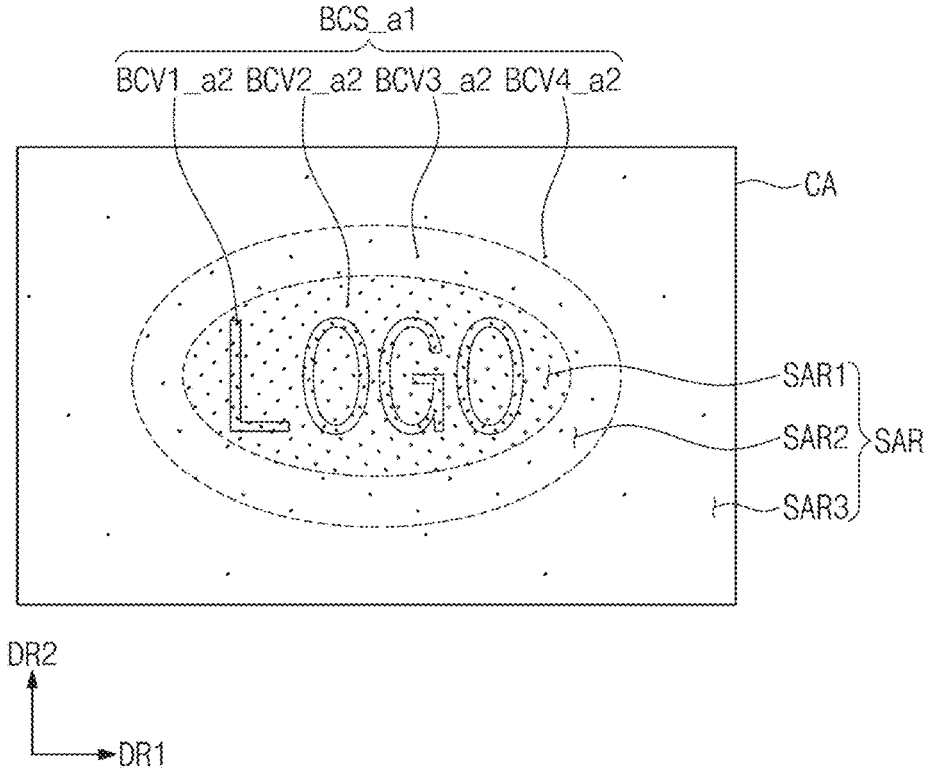
FIGS. 8A and 8B are conceptual diagrams for describing an operation of a third correction block according to an embodiment of the disclosure.
Figure 8B:
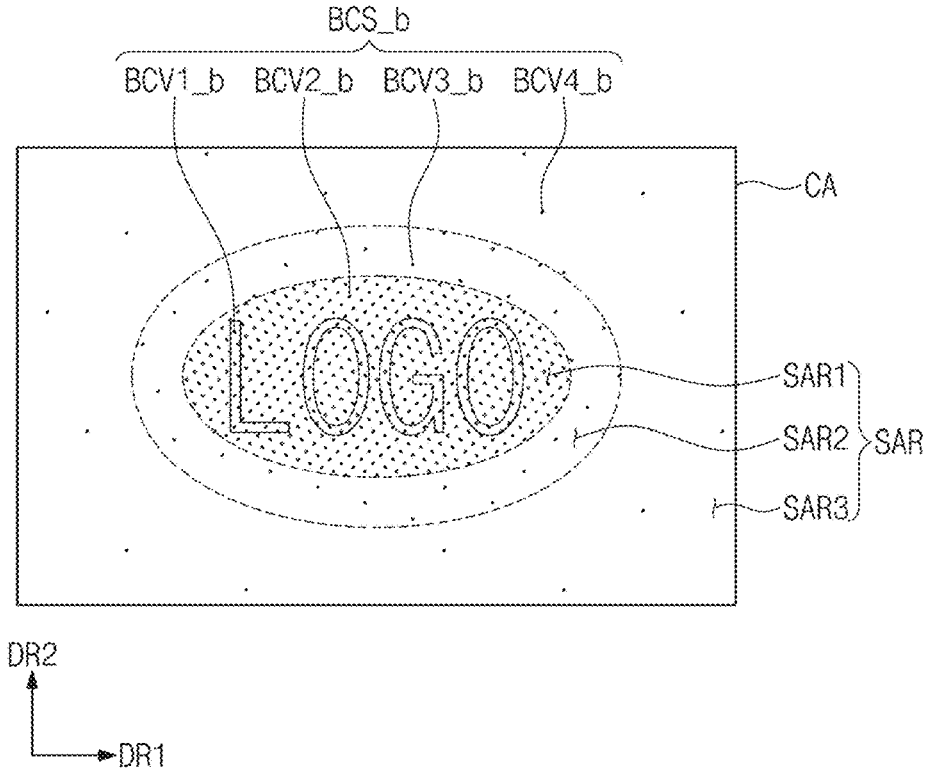

FIG. 6 is a block diagram illustrating a luminance correction block according to an embodiment of the disclosure. FIGS. 7A and 7B are conceptual diagrams for describing an operation of a correction grayscale generation block according to an embodiment of the disclosure. FIGS. 8A and 8B are conceptual diagrams for describing an operation of a third correction block according to an embodiment of the disclosure. Hereinafter, the same or like reference numerals will be given to the same or like components and signals as those described above with reference to FIGS. 3 to 5, and any repetitive detailed descriptions thereof will be omitted or simplified.

Referring to FIGS. 6 to 8B, an embodiment of a luminance correction block BCB_b further includes an extraction block EXB and a correction grayscale generation block CGB.

The extraction block EXB receives the image signal RGB from the outside. The extraction block EXB extracts an area calculation signal CAS for the correction area CA in which the correction image CIM (refer to FIG. 1) is displayed from the image signal RGB. The extraction block EXB may include an artificial intelligence program that performs machine learning for detecting the correction image CIM. In an embodiment of the disclosure, the extraction block EXB may extract the area calculation signal CAS for the correction area CA in which the correction image CIM of which luminance is to be corrected by the luminance correction block BCB_b is displayed to prevent the occurrence of the afterimage by using machine learning based on a convolutional neural network model, etc. In such an embodiment, the extraction block EXB may extract the area calculation signal CAS using an artificial intelligence program that performs not only machine learning but also deep learning. The extraction block EXB may detect the correction image CIM by analyzing the image IM displayed on the display panel DP for a preset time. In such an embodiment, the correction image CIM may be detected by analyzing frames of the image IM repeated at a specific time.

A first correction block CB1_b receives the area calculation signal CAS from the extraction block EXB. The first correction block CB1_b may generate an area correction signal ACS_b based on the area calculation signal CAS.

The correction grayscale generation block CGB receives the image signal RGB from the outside. The correction grayscale generation block CGB generates a correction grayscale signal CGS obtained by correcting the grayscale of the image signal RGB. In an embodiment of the disclosure, the correction grayscale generation block CGB may generate a correction grayscale by multiplying the grayscale of the image signal RGB by a correction constant, and may generate the correction grayscale signal CGS based on the correction grayscale.

In an embodiment of the disclosure, the correction constant may be defined as in Equation 1 below.

$$n = \frac{Gmax}{a} \quad \text{[Equation 1]}$$

In Equation 1, 'n' denotes a correction constant, 'a' denotes a constant for determining the 'n', and is a real number between '1' and Gmax. Gmax denotes a preset highest grayscale. Hereinafter, an embodiment where the highest grayscale is 255 will be described.

In such an embodiment of the disclosure, the correction constant may have the value of 'n', and 'n' may be a real number greater than '1'. In such an embodiment of the disclosure, the grayscale of the image signal RGB may be a natural number between '0' and '255'. The correction grayscale may be equal to or greater than the grayscale of the image signal RGB.

In an embodiment of the disclosure, the correction grayscale generation block CGB may set the highest grayscale of the correction grayscale to 255. In such an embodiment, even if the value obtained by multiplying the grayscale of the image signal RGB by the correction constant exceeds 255, the correction grayscale generation block CGB may generate the correction grayscale signal CGS, based on the correction grayscale of 255.

In an embodiment of the disclosure, the correction constant may be determined such that the image signal RGB having a higher grayscale than the preset reference grayscale among the image signals RGB has the same correction grayscale as each other. The correction constant may be determined based on the preset reference grayscale of the image signal RGB. In such an embodiment, when the preset reference grayscale of the image signal RGB is 200, the value of 'a' ('a' is approximately 199.22) may be determined such that the correction constant becomes 1.28. In this case, the preset reference grayscale may be a grayscale set such that a luminance correction amount corrected by the luminance correction block BCB_b is the same as the luminance correction amount corrected when the grayscale of the image signal RGB is the highest grayscale.

When the correction constant is 1.28, the image signal RGB having a grayscale of 200 or more has the same correction grayscale of 255. Accordingly, the correction grayscale generation block CGB may generate the same correction grayscale signal CGS based on the image signal RGB having 200 or more grayscales.

In an embodiment of the disclosure, as the preset reference grayscale decreases, the correction constant may increase.

The correction grayscale generation block CGB may generate the correction grayscale signal CGS by normalizing the correction grayscale to 255 as the highest grayscale. In an embodiment of the disclosure, a second correction block CB2_*b* may generate a luminance correction signal BCS_b after normalizing the correction grayscale based on the correction grayscale signal CGS. The third correction block CB3_*b* may correct the luminance of the correction image CIM based on the image signal RGB and the luminance correction signal BCS_b and may generate image data IMD_b.

FIG. 7A illustrates the grayscale of the image signal RGB corresponding to the correction image CIM. FIG. 7B illustrates the correction grayscale of the correction grayscale signal CGS generated through the correction grayscale generation block CGB.

In an embodiment of the disclosure, the grayscale of the logo image LIM illustrated in FIG. 7A may be 255, and the grayscale of a first logo background image SLBI1 displayed in the first sub-area SAR1 may be lower than 255 and may have a value greater than the preset reference grayscale. The grayscale of a second logo background image SLBI2 displayed in the second sub-area SAR2 and the grayscale of a third logo background image SLBI3 displayed in the third sub-area SAR3 may have values less than the reference grayscale.

The correction grayscale of a corrected logo image C_LIM illustrated in FIG. 7B may be 255. The correction grayscale of a corrected first logo background image C_SLBI1 of a corrected logo background image C_LBI may be 255. The correction grayscale of a corrected second logo background image C_SLBI2 of the corrected logo background image C_LBI and the correction grayscale of a corrected third logo background image C_SLBI3 of the corrected logo background image C_LBI may be less than 255.

When the preset highest grayscale is 255, the correction grayscale generation block CGB may normalize such that the correction grayscale signal CGS corresponding to the corrected logo image C_LIM and the corrected first logo background image C_SLBI1 is replaced with a value of '1', and the correction grayscale signal CGS corresponding to the corrected second and third logo background images C_SLBI2 and C_SLBI3 is replaced with a value of less than '1'.

The second correction block CB2_*b* receives the area correction signal ACS_b from the first correction block CB1_*b* and receives the normalized correction grayscale signal CGS from the correction grayscale generation block CGB. The second correction block CB2_*b* may generate the luminance correction signal BCS_b, based on the area correction signal ACS_b and the correction grayscale signal CGS.

In FIG. 8A, first to fourth luminance correction values BCV1_*a*2, BCV2_*a*2, BCV3_*a*2, and BCV4_*a*2 of the luminance correction signal BCS_*a*1 that is generated by the second correction block CB2_*b*, based on the area correction signal ACS_b and the image signal RGB illustrated in FIG. 7A are illustrated. The luminance correction signal BCS_*a*2 illustrated in FIG. 8A may be a signal generated in the same manner as the luminance correction signal BCS_a illustrated in FIG. 5.

In FIG. 8B, first to fourth luminance correction values BCV1_*b*, BCV2_*b*, BCV3_*b*, and BCV4_*b* of the luminance correction signal BCS_b that is generated by the second correction block CB2_*b*, based on the area correction signal ACS_b and the correction grayscale signal CGS illustrated in FIG. 7B are illustrated. Referring to FIGS. 7B and 8B, in the correction grayscale signal CGS, the correction grayscale of the corrected logo image C_LIM and the correction grayscale of the corrected first logo background image C_SLBI1 are equal to 255. Accordingly, the first luminance correction value BCV1_*b* and the second luminance correction value BCV2_*b* of the luminance correction signal BCS_b may be the same as each other. As a result, when the correction grayscale signal CGS is generated through the correction grayscale generation block CGB, the degree to which the luminance correction block BCB_b corrects the luminance of the image signal RGB having a higher grayscale than the preset reference grayscale may be the same as the degree of correcting the luminance of the image signal RGB having the highest grayscale.

Figure 9:
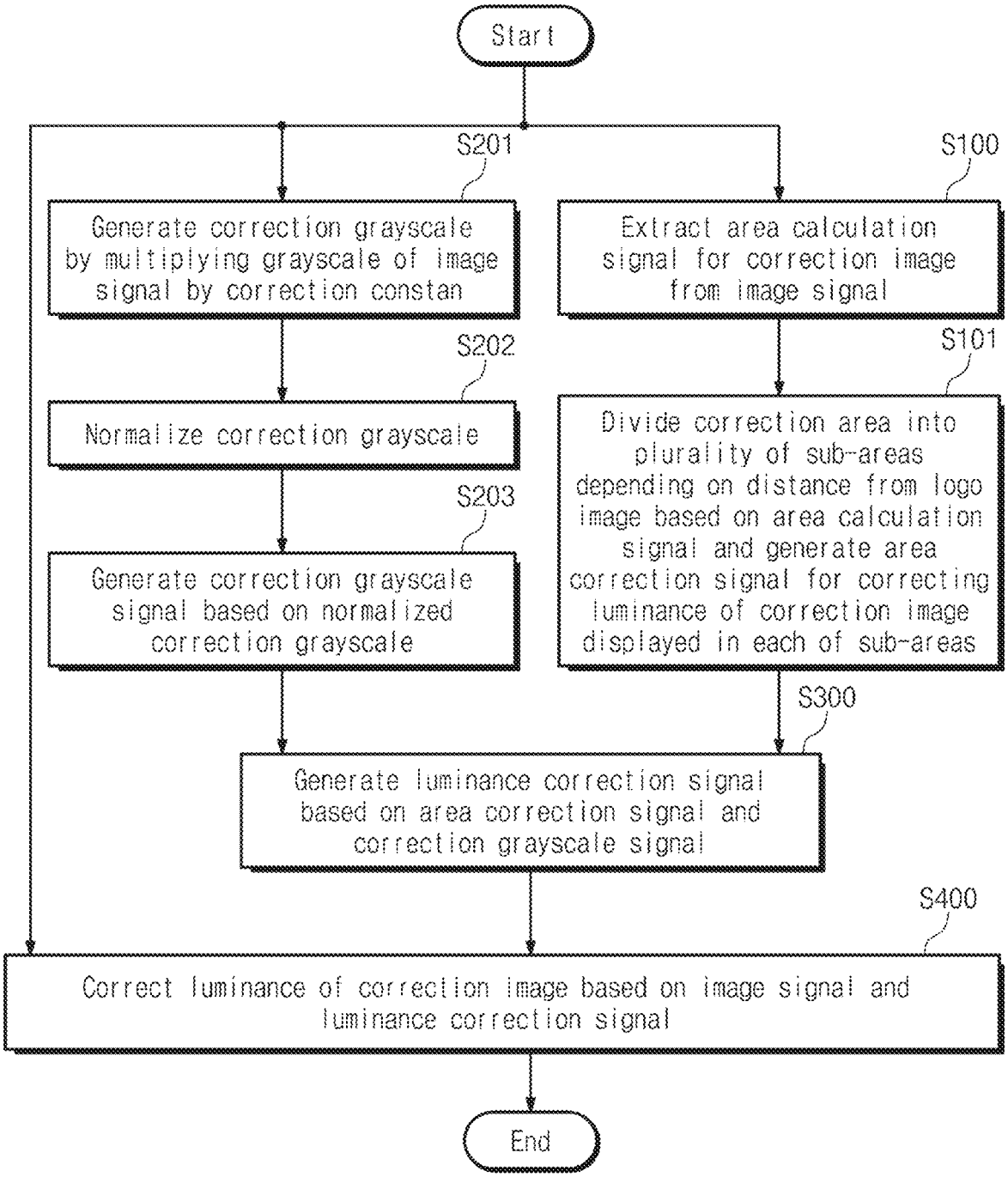
FIG. 9 is a flowchart illustrating an operation of a luminance correction block according to an embodiment of the disclosure.

FIG. 9 is a flowchart illustrating an operation of a luminance correction block according to an embodiment of the disclosure.

Referring to FIGS. 6 and 9, the luminance correction block BCB_b receives the image signal RGB from the outside, and may extract the area calculation signal CAS for the correction image CIM (refer to FIG. 1) from the image signal RGB (S100). The luminance correction block BCB_b divides the correction area CA (refer to FIG. 5) into a plurality of sub-areas SAR1, SAR2, and SAR3 (refer to FIG. 5) depending on the distance from the logo image LIM, based on the area calculation signal CAS and generates the area correction signal ACS_b for correcting the luminance of the correction image CIM displayed in each of the sub-areas SAR1, SAR2, and SAR3 (S101). In an embodiment of the disclosure, operation S100 of extracting the area calculation signal CAS by the luminance correction block BCB_b may be omitted, and the area correction signal ACS_b may be generated from the image signal RGB.

The luminance correction block BCB_b generates the correction grayscale by multiplying the grayscale of the image signal RGB by the correction constant (S201), normalizes the correction grayscale (S202), and may generate the correction grayscale signal CGS based on the normalized correction grayscale (S203). In an embodiment of the disclosure, the generating the correction grayscale by the luminance correction block BCB_b (S201) and the normalizing the correction grayscale (S202) may be performed in one operation.

The luminance correction block BCB_b may generate the luminance correction signal BCS_b, based on the area correction signal ACS_b and the correction grayscale signal CGS (S300).

In an alternative embodiment of the disclosure, the generating the correction grayscale by the luminance correction block BCB_b (S201), the normalizing the correction grayscale (S2020, and the generating the correction grayscale signal based on the normalized correction grayscale (S203) may be omitted. In such an embodiment, the luminance correction block BCB_b may generate the luminance correction signal BCS_b, based on the image signal RGB and the area correction signal ACS_b.

The luminance correction block BCB_b may correct the luminance of the correction image CIM, based on the image signal RGB and the luminance correction signal BCS_b (S400).

According to embodiments of the disclosure, luminance of a logo image and a logo background image may be corrected based on a distance from the logo image and a grayscale of the image displayed on the display panel such that image quality degradation due to a lowered grayscale of a logo background image around a logo image may be effectively prevented from being recognized by a user.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel including a correction area, in which a correction image including a logo image and a logo background image around the logo image is displayed; and a panel driving block which receives an image signal and transmits a data signal to the display panel, and wherein the panel driving block includes a luminance correction block which corrects a luminance of the correction image, and wherein the luminance correction block includes:

a first correction block which divides the correction area into a plurality of sub-areas, based on a distance from the logo image and generates an area correction signal for correcting the luminance of the correction image displayed in each of the sub-areas, wherein the area correction signal includes a plurality of area correction values which are weights corresponding to the sub-areas, respectively, and each of the area correction values decreases as the distance of a corresponding sub area thereof from the logo image increases;

a second correction block which receives the image signal and the area correction signal, and generates a luminance correction signal for correcting the luminance of the correction image displayed in each of the sub-areas, based on a grayscale of the image signal and the area correction signal; and a third correction block which corrects the luminance of the correction image, based on the image signal and the luminance correction signal.

2. The display device of claim 1, wherein the luminance correction block further includes a correction grayscale generation block which receives the image signal and generates a correction grayscale signal obtained by correcting the grayscale of the image signal.

3. The display device of claim 2, wherein the second correction block receives the area correction signal from the first correction block and receives the correction grayscale signal from the correction grayscale generation block, and wherein the second correction block generates the luminance correction signal based on the area correction signal and the correction grayscale signal.

4. The display device of claim 2, wherein the correction grayscale generation block generates the correction grayscale signal, based on a correction grayscale obtained by multiplying the grayscale of the image signal by a correction constant.

5. The display device of claim 4, wherein the correction constant has a value of n, wherein n is a real number equal to or greater than 1.

6. The display device of claim 5, wherein the image signal having a greater grayscale than a preset reference grayscale among image signals has a same grayscale as a grayscale in the correction grayscale signal.

7. The display device of claim 6, wherein, as the preset reference grayscale decreases, the correction constant increases.

8. The display device of claim 6, wherein the correction grayscale generation block normalizes the correction grayscale to generate the correction grayscale signal.

9. The display device of claim 1, wherein the luminance correction block further includes an extraction block which extracts an area calculation signal for the correction area from the image signal, and wherein the first correction block receives the area calculation signal from the extraction block and generates the area correction signal based on the area calculation signal.

10. The display device of claim 1, wherein the sub-areas include a first sub-area in which the logo image is displayed, a third sub-area in which the logo background image is displayed, and a second sub-area disposed between the first sub-area and the third sub-area, and wherein the area correction signal includes a first area correction value for correcting a luminance of an image displayed on the first sub-area, a second area correction value for correcting a luminance of an image displayed on the second sub-area, and a third area correction value for correcting a luminance of an image displayed on the third sub-area.

11. The display device of claim 10, wherein the first area correction value is greater than the second area correction value and the third area correction value, and wherein the second area correction value is greater than the third area correction value.

12. The display device of claim 1, wherein, as the grayscale of the image signal is lower, a luminance correction amount of the correction area corrected through the luminance correction block becomes smaller.

13. The display device of claim 1, wherein the panel driving block includes:

a controller which receives the image signal from an outside and generates image data based on the image signal; and a source driver which receives the image data from the controller and transmits the data signal to the display panel, and wherein the luminance correction block is included in the controller.

14. A method of driving a display device which includes a display panel including a correction area, in which a correction image including a logo image and a logo background image around the logo image is displayed, and a panel driving block which receives an image signal and transmits a data signal to the display panel, the method comprising:

correcting a luminance of the correction image when the data signal is generated based on the image signal, and wherein the correcting the luminance of the correction image includes:

dividing the correction area into a plurality of sub-areas based on a distance from the logo image, and generating an area correction signal for correcting the luminance of the correction image displayed in each of the sub-areas, wherein the area correction signal includes a plurality of area correction values which are weights corresponding to the sub-areas, respectively, and each of the area correction values decreases as the distance of a corresponding sub area thereof from the logo image increases;

receiving the image signal and the area correction signal, and generating a luminance correction signal for correcting the luminance of the correction image displayed in each of the sub-areas, based on a grayscale of the image signal and the area correction signal; and correcting the luminance of the correction image, based on the image signal and the luminance correction signal.

15. The method of claim 14, wherein the correcting the luminance of the correction image further includes:

receiving the image signal, and generating a correction grayscale signal based on a correction grayscale obtained by multiplying the grayscale of the image signal by a correction constant.

16. The method of claim 15, wherein the generating the luminance correction signal includes:

receiving the area correction signal from a first correction block;

receiving the correction grayscale signal from a correction grayscale generation block; and generating the luminance correction signal based on the area correction signal and the correction grayscale signal.

17. The method of claim 15, wherein the image signal having a greater grayscale than a preset reference grayscale among image signals has a same grayscale as a grayscale in the correction grayscale signal.

18. The method of claim 15, wherein the correction grayscale signal is generated by normalizing the correction grayscale.

19. The method of claim 14, wherein the correcting the luminance of the correction image further includes:

extracting an area calculation signal for the correction image from the image signal, and wherein the area correction signal is generated based on the area calculation signal.

20. The method of claim 14, wherein the sub-areas include a first sub-area in which the logo image is displayed, a third sub-area in which the logo background image is displayed, and a second sub-area disposed between the first sub-area and the third sub-area, wherein the area correction signal includes a first area correction value for correcting a luminance of an image displayed on the first sub-area, a second area correction value for correcting a luminance of an image displayed on the second sub-area, and a third area correction value for correcting a luminance of an image displayed on the third sub-area, wherein the first area correction value is greater than the second area correction value and the third area correction value, and wherein the second area correction value is greater than the third area correction value.

* * * * *